US005842074A

United States Patent [19]

Nishida et al.

[11] Patent Number: 5,842,074

[45] Date of Patent: Nov. 24, 1998

[54] PHOTOGRAPHIC DEVELOPING APPARATUS AND METHOD OF SUPPLYING WATER TO THE APPARATUS

[75] Inventors: Shigeki Nishida; Yuji Yamamoto, both of Wakayama, Japan

[73] Assignee: Noritsu Koko Co. Ltd., Wakayama-ken, Japan

[21] Appl. No.: 859,812

[22] Filed: May 19, 1997

[30] Foreign Application Priority Data

May 20, 1996 [JP] Japan ..... 8-124441

[51] Int. Cl.[6] ..... G03D 3/02

[52] U.S. Cl. ..... 396/578; 396/626; 430/398

[58] Field of Search ..... 396/626, 630, 396/578, 568; 430/30, 398–400

[56] References Cited

U.S. PATENT DOCUMENTS

| | | | |
|---|---|---|---|
| 4,314,753 | 2/1982 | Kaufmann | 396/578 |
| 4,937,608 | 6/1990 | Ishikawa et al. | 396/569 |
| 5,177,521 | 1/1993 | Mogi et al. | 396/571 |
| 5,452,045 | 9/1995 | Koboshi et al. | 396/626 |
| 5,460,926 | 10/1995 | Komatsu et al. | 430/401 |

FOREIGN PATENT DOCUMENTS

| | | | |
|---|---|---|---|
| 452940 | 4/1991 | European Pat. Off. | G03D 3/06 |
| 456167 | 5/1991 | European Pat. Off. | G03D 3/06 |
| 1254959 | 10/1989 | Japan | G03D 3/06 |
| 1254960 | 11/1989 | Japan | G03D 3/06 |
| 254264 | 2/1990 | Japan . | |
| 41756 | 1/1992 | Japan . | |

*Primary Examiner*—D. Rutledge
*Attorney, Agent, or Firm*—Fulbright & Jaworski, LLP

[57] ABSTRACT

A photographic processing apparatus includes a unit for supplying processing liquid to a processing tank, a unit for forcibly draining processing liquid from the tank, a unit for means for measuring an amount of processing liquid in the tank and a unit for supplying water to the tank. The apparatus further includes a unit for determining an amount of water evaporated from the liquid in the tank based on amounts of liquid coming in and out of the tank. The water supplying unit supplies an amount of additional water to the tank based on the amount of water evaporation determined by the evaporation amount determining unit.

10 Claims, 6 Drawing Sheets

PHOTOGRAPHIC DEVELOPING APPARATUS AND METHOD OF SUPPLYING WATER TO THE APPARATUS

BACKGROUND OF THE INVENTION

The present invention relates generally to art of compensating for water content evaporated from processing liquid used in a photographic developing apparatus.

DESCRIPTION OF THE RELATED ART

A photographic developing apparatus includes a plurality of processing tanks including a developing tank, a bleaching tank and a fixing tank respectively storing processing liquids, i.e. developing liquid, bleaching liquid and fixing liquid for together effecting a series of developing steps. After its exposure, photosensitive material is developed by being caused to pass the respective tanks one after another. Then, this developed material is dried and discharged from the apparatus. Each processing liquid needs to be replenished with additional liquid, depending on the amount of photosensitive material processed thereby so as to maintain a predetermined concentration. For proper maintenance of the liquid concentration, it is also necessary to supply additional water to the liquid, in order to compensate for water content evaporated from the liquid. However, the amount of water evaporation may vary depending on the temperature and humidity of the ambience, temperature of the processing liquid and also on whether the apparatus is under operation or out of operation.

In an attempt to cope with the above, according to the art disclosed in U.S. patent Ser. No. 4,937,608 (corresponding to the Japanese laid-open patent gazette Hei. 2-54264) for example, an ambience temperature sensor, an ambience humidity sensor and a liquid temperature sensor are provided to obtain an ambience temperature, an ambience humidity and a liquid temperature, respectively. Then, by using these data as parameters, the reference obtains a data look-up table, with reference to which, an evaporation amount is estimated and the amount of water to be supplied is determined based on the estimated evaporation amount. According to further art disclosed in U.S. patent Ser. No. 5,177,521 (corresponding to the Japanese laid-open patent gazette Hei. 4-1756), evaporation ratios are obtained and determined in advance for a stand-by condition, an out-of-operation condition and in-operation condition of the apparatus, respectively. Then, by compensating for these respective rates by a humidity condition, the amount of water to be supplied is determined.

In both of the conventional art described above, the evaporation amounts are determined through estimation from the experimentally obtained data, using the ambience conditions such as temperature and humidity as parameters. In actuality, however, such ambience conditions around the apparatus can often vary even with a slight change in the installed position of the apparatus. Thus, it is difficult to match the estimated evaporation amount from the data table, which comprises data experimentally obtained in correlation with a variety of ambience temperature and humidity conditions, with the actual evaporation amount, i.e. the amount of evaporation that actually occurs when the apparatus is in operation.

SUMMARY OF THE INVENTION

In view of the above-described state of the art, a primary object of the present invention is to provide a photographic developing apparatus and a method capable of constantly supplying a proper amount of water by directly calculating the amount of water evaporated from the processing tank rather than indirectly estimating or calculating it from experimentally obtained values of various ambience conditions.

For accomplishing the above-noted object, according to one aspect of the present invention, there is provided a photographic processing apparatus comprising: means for supplying processing liquid to a processing tank; means for forcibly draining processing liquid from the tank; means for measuring an amount of processing liquid in the tank; means for determining an amount of water evaporated from the liquid in the tank based on amounts of liquid coming in and out of the tank; and means for supplying an amount of additional water to the tank based on the amount of water evaporation determined by the evaporation amount determining means.

With the apparatus described above, for proper determination of the required amount of water supply, the apparatus attends soley to the amounts of liquid coming in and out of the processing tank. Then, with precision management of these liquid input and output amounts to and from the processing tank, a decrease observed in the amount of liquid in the tank to be controlled is determined as the amount of water content which has evaporated from the liquid. For enabling such precision management of the liquid input and amount amounts, the apparatus of the present invention does not rely on the conventional liquid replenishing method which replenishes liquid to the tank while causing it to overflow from the tank. Rather, this apparatus employs the liquid draining means which forcibly drains the liquid for an exact replenishing amount or a replenishing amount plus or minus a correction amount determined by the precision management. As described above, in the apparatus of the invention, for the determination of the water evaporation amount, the experimentally measured values of ambience conditions such as temperature and humidity are not used as the parameters. Hence, the apparatus does not require any sensors for obtaining such values. Above all, this apparatus is capable of providing an accurate evaporation amount which does not vary whether the apparatus may be placed in a non-standard ambience condition or a standard ambience condition.

According to one preferred embodiment of the present invention, the apparatus further comprises means for determining an amount of material to pass the tank to be developed therethrough; and the evaporation amount determining means includes a carry-in amount determining unit for determining an amount of the liquid carried with the material into the tank based on the amount of the passed material determined by the passage amount determining means and a carry-out amount determining unit for determining an amount of liquid carried with the material out of the tank based on the amount of the passed material determined by the passage amount determining means. With this construction, it becomes possible to determine the amounts of liquid carried with the material into and out of the tank in association with the passage thereof through the tank. These amounts, which also relate to the input and output amounts of the processing liquid in and out of the processing tank, may be small in magnitude, but still are significant for the precision management of the input and output amounts. It has been experimentally established that the carry-in and carry-out amounts are substantially in proportion to the amount of the material passed. Hence, for example, the carry-in and carry-out amounts relative to a predetermined variety of material passage amounts may be provided in the form of tabulated data which can be stored in e.g. a ROM.

According to a further embodiment of the present invention, the evaporation amount is calculated from parameters including a change amount, replenishing amount, draining amount, carry-in amount and carry-out amount, which are measured for a predetermined period of the liquid stored in the processing tank. The change amount, the replenishing amount and the draining amount can be obtained simply and accurately by means of conventional sensors. Thus, the use of these data as parameters does not lead to significant cost increase. In particular, if the evaporation amount is calculated by a simple calculation of subtracting the draining amount and the carry-out amount from the sum of the change change amount, the replenishing amounts and the carry-in amount measured for the predetermined period, the load required of the control scheme for the evaporation amount calculation may be advantageously small.

As described above, any variation in the concentration of the processing liquid due to water evaporation therefrom may be compensated for by supplying an amount of additional water corresponding to the evaporation amount calculated in the above-described manner. Further, the replenishment of the liquid for the purpose of restricting quality deterioration or fatigue of the processing liquid, such as concentration variation thereof due to passage of the material therethrough may be realized by driving the liquid supplying means and the liquid draining means, based on the amount of the material passed which amount is determined by the passage amount determining means. Any replenishments of the processing liquid which have taken place during the predetermined period of the evaporation amount calculation are all recorded to be utilized for the evaporation calculation in the next cycle.

Further, if the replenishment of the processing liquid is effected in such a manner that the amount of processing liquid present in the processing tank is constantly maintained within a predetermined range, it is possible to always maintain the liquid amount at a proper level and also to prevent the liquid from inadvertently running short or excessive.

The measurements of the replenishing amount, draining amount of the processing liquid and of the supply amount of the water may be effected by controlling the operation periods of a liquid supplying pump, a liquid draining pump and a water supplying pump. Preferably, however, these measurements are effected by measuring the amounts of liquid present in a liquid supplying tank, a liquid draining tank and a water supplying tank or in pipes communicating with these tanks. Then, it becomes advantageously possible to monitor the operational conditions in the respective pumps and control units associated therewith, through these liquid amount measurements.

According to a further aspect of the present invention for accomplishing the other object thereof, there is provided a method of supplying water to a photographic processing apparatus which includes means for supplying processing liquid to a processing tank, means for forcibly draining processing liquid from the tank, means for measuring an amount of processing liquid in the tank, and means for supplying an amount of additional water to the tank, which method comprises the steps of: determining an amount of water evaporated from the liquid in the tank based on amounts of liquid coming in and out of the tank; and supplying an amount of additional water to the tank based on the determined amount of water evaporation.

With the above method, as described hereinbefore in connection with the apparatus of the invention, in the determination of the water evaporation amount, the experimentally measured values of ambience conditions such as temperature and humidity are not used as the parameters. Hence, the method does not require any sensors or calculations therefor.

Preferably, in the step of determining the evaporation amount, an amount of material to pass the tank to be developed therethrough is determined. Based on this determined amount of the material passed, a carry-in amount of the liquid carried with the material into the tank and a carry-out amount of the liquid carried with the material out of the tank are determined. Then, from these determined carry-in and carry-out liquid amounts, the water evaporation amount may be readily calculated. For instance, the evaporation amount may be calculated from parameters including a change amount, replenishing amount, draining amount, carry-in amount and carry-out amount, which are measured for a predetermined period of the liquid stored in the processing tank.

Further and other objects, features and effects of the invention will become more apparent from the following more detailed description of the embodiments of the invention with reference to the accompanying drawings.

DESCRIPTION OF THE PREFERRED EMBODIMENTS

A photographic developing apparatus according the invention will be described hereinafter with reference to the accompanying drawings.

Figure 1:
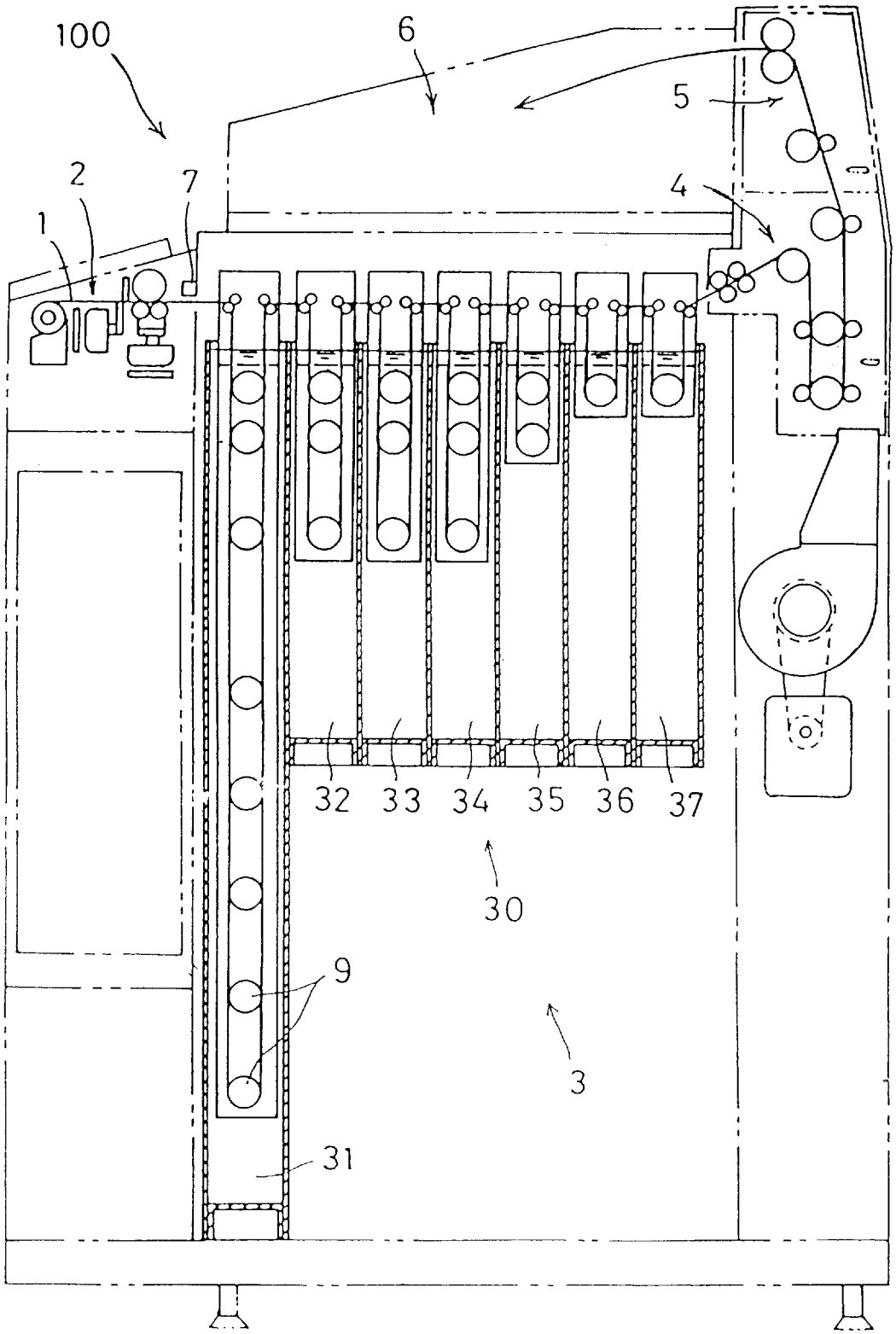
FIG. 1 is a vertical section of a photographic developing apparatus relating to the present invention.

As shown in FIG. 1, this photographic developing apparatus 100 includes a film charging section 2 for charging a film 1, an example of photosensitive material, having a leader connected to a leading end thereof, a film developing section 3 for developing the film 1 fed from the film charging section 2, a film drying section 4 for drying the developed film 1 with hot air heated by a drying heater and fed by a drying fan, a film discharging section 5 for discharging the dried film 1, and a film receiving section 6 for temporarily holding the discharged film 1.

The film 1 charged into the film charging section 2 is transported as being pinched between a transport roller and a free roller and introduced into the film developing section 3. At an entrance to this film developing section 3, there is disposed an optical sensor 7. Then, based on a detection signal from the sensor 7 and also on a film transporting speed, the length of the film introduced into the film developing section 3 to be developed therein may be determined.

Figure 2:
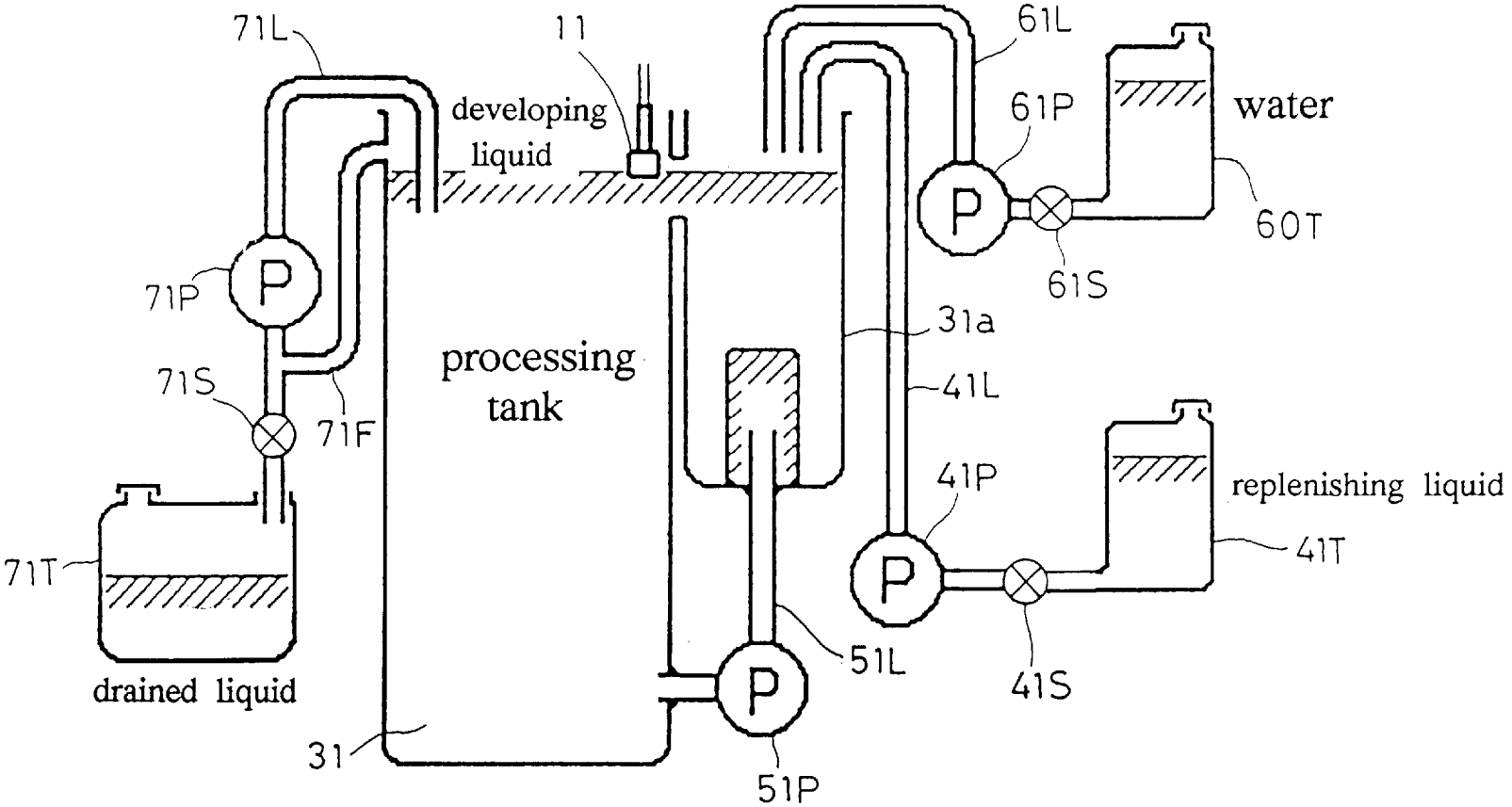
FIG. 2 is a schematic of a processing tank storing developing liquid.

The film developing section 3 includes a developing area 30 having total seven processing tanks 31 through 37 charged respectively with such development processing liquids as developing liquid, bleaching liquid, fixing liquid, and stabilizing liquid, and transporting roller units 9 of different lengths for transporting the film 1 within the developing area 30. The seven processing tanks 31 through 37 are disposed side by side in a predetermined order along the transporting direction of the film 1. The deepest of all is the developing liquid tank 31, then comes the bleaching liquid tank 32, which is followed by two fixing liquid tanks 33, 34 and then by three shallow stabilizing liquid tanks 35 through 37. These tanks, though different in the depths, are substantially identical in construction. FIG. 2 is a schematic in vertical section of the developing liquid tank 31.

As shown in FIG. 2, the developing liquid tank 31 includes, at an upper region thereof, a sub tank 31*a*, with the upper area of the tank 31 being communicated with the sub tank 31*a*. The sub tank 31*a* is connected with a liquid replenishing pipe 41L forming a liquid replenishing line. In order to maintain the chemical activity of the developing liquid at a fixed level, a liquid supplying pump 41P is activated to replenish fresh developing liquid from a developing liquid tank 41T into the sub tank 31*a* via the replenishing pipe 41L. Between the developing liquid tank 41T and the supplying pump 41P, there is interposed a flow-amount 41S for measuring the amount of developing liquid supplied into the sub tank 31*a*. Further, the bottom of the sub tank 31*a* and that of the processing tank 31 are communicated with each other via a circulating pipe 51L having a filter to form a liquid circulating line. In the course of the circulating pipe 51L, there is incorporated a circulating pump 51P. The sub tank 31*a* accommodates therein such components as a heater for heating the developing liquid and a temperature sensor for detecting the temperature of developing liquid. These components are not shown in the figure.

The sub tank 31*a* is connected also with a water supplying pipe 61L, an example of water supplying means, for forming a water supplying line. Then, in order to compensate for water content evaporated from the developing liquid, a water supplying pump 61P is activated when necessary to supply additional water from a water supplying tank 60T to the sub tank 31*a* via a water supplying pipe 61L. Between the water supplying tank 60T and the water supplying pump 61P, there is interposed a flow-amount sensor 61S for measuring the amount of water supplied into the sub tank 31*a*.

The developing liquid processing tank 31 is connected also with a drain pipe 71L, an example of draining means, forming a liquid draining line. In operation, a draining pump 71P is activated in a simultaneous or sequential manner during the replenishment of the developing liquid, thereby to drain a predetermined amount of fatigued developing liquid from the processing tank 31 into a drain tank 71S. Between the draining pump 71P and the drain tank 71T, there is interposed a flow-amount sensor 71S for measuring the amount of developing liquid drained. Further, between the developing liquid processing tank 31 and the drain tank 71T, there is also provided an overflow drain pipe 71F in order to cope with an accidental overflow of the liquid. The developing liquid tank 31 further includes a liquid level sensor 11 for measuring the current level, i.e. change in the level of the developing liquid present in the developing liquid tank 31 including its sub tank 31*a*.

The above-described constructions of the sub tank and the liquid circulating line are identical for the other processing tanks, and therefore will not be described. Further, in the instant embodiment, the liquid replenishing line is provided to the processing tanks 31, 32, 34 and 37. The water supplying line and the liquid draining line are provided to the processing tanks 31 and 32. Accordingly, the level sensor 12 is provided also in the processing tank 32. The communication of the stabilizing liquid from a sub tank 34*a* of the processing liquid 34 to a sub tank 33*a* of the processing tank 33 is effected by the well-known overflow principle using an unillustrated cascaded pipe assembly.

Figure 3:
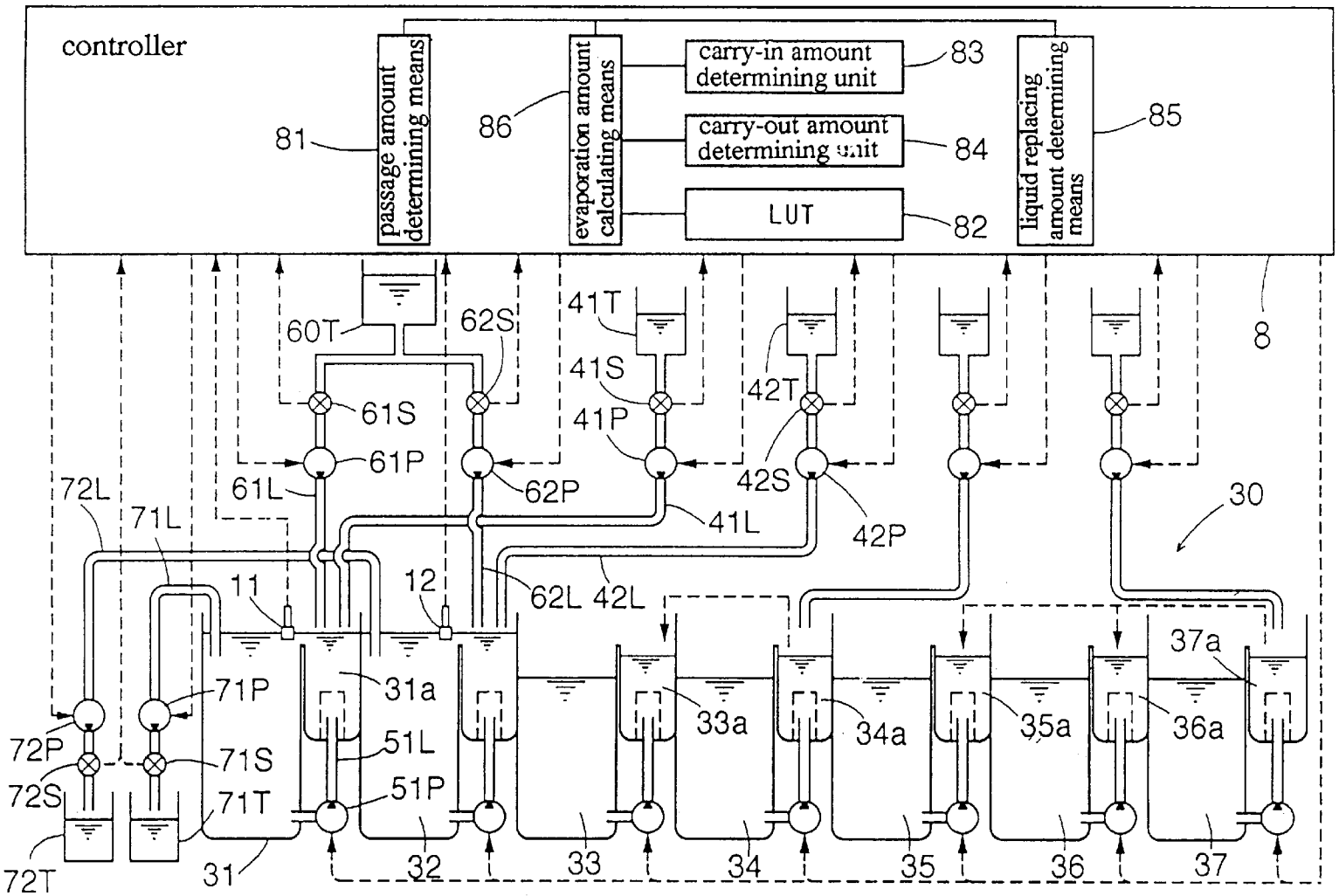
FIG. 3 is a block diagram of a control system controlling the processing liquid in consideration of liquid replenishment and water evaporation compensation.

The above-described pumps and sensors provided in the developing liquid processing tank 31 are connected respectively with a controller 8. This controller 8 controls the various components of the photographic processing apparatus 100. In the following description, however, there will be described only those functions thereof relating to the evaporation compensation to which the present invention attends. And, FIG. 3 too shows only those components relating to this particular function. In this embodiment, the water evaporation compensation is effected for the developing liquid tank 31 and the bleaching liquid tank 32. Therefore, FIG. 3 shows a replenishing pipe 42L, a supplying pump 42P, a flow-amount sensor 42S together forming a liquid replenishing line for the bleaching liquid tank 32, a water supplying tank 60T, a water supplying pipe 62L, a water-supplying pump 62P and a flow-amount sensor 62S together forming a water supplying line for the bleaching liquid tank 32 and a drain pipe 72L, a draining pump 72P, a flow-amount sensor 72S and a drain tank 72T together forming a liquid draining line for the bleaching liquid tank 32.

The controller 8 includes a passage amount determining means 81 for determining a length of the film 1, i.e. the amount of film 1 passed based on a detection signal from the optical sensor 7 and the film transporting speed, an LUT (look-up table) 82 comprised of tabulated data generated from experimentally obtained values of the carry-in and carry-out amounts of the film 1 in and out of the processing tank relative to the passage amount thereof, a carry-in amount determining unit 83 for determining the amount of liquid carried into the processing tank, a carry-out amount determining unit 84 for determining the amount of liquid carried out of the processing tank, a liquid replacing amount determining means 85 for determining a replenishing amount and a draining amount of the liquid based on the passage amount, and an evaporation amount calculating means 86 for calculating an evaporation amount based on the detection signals from the liquid level sensors 11, 12, the flow-amount sensors 41S, 61S and 71S incorporated in the liquid replenishing line and draining line, the liquid level change amount described above as well as the carry-in and carry-out amounts. The controller 8 is constructed from an electronic control circuit including a microcomputer as a major component thereof. And, the above-described respective functions of this controller are realized through appropriate programming of the microcomputer.

Next, with reference to flow charts of FIGS. 4, 5 and 6, there will be described a control scheme relating to processing liquid management in consideration of the processing liquid replenishment and water evaporation. In this embodiment, this control scheme is applied to the developing liquid tank 31 and the bleaching liquid tank 32.

Figure 4:
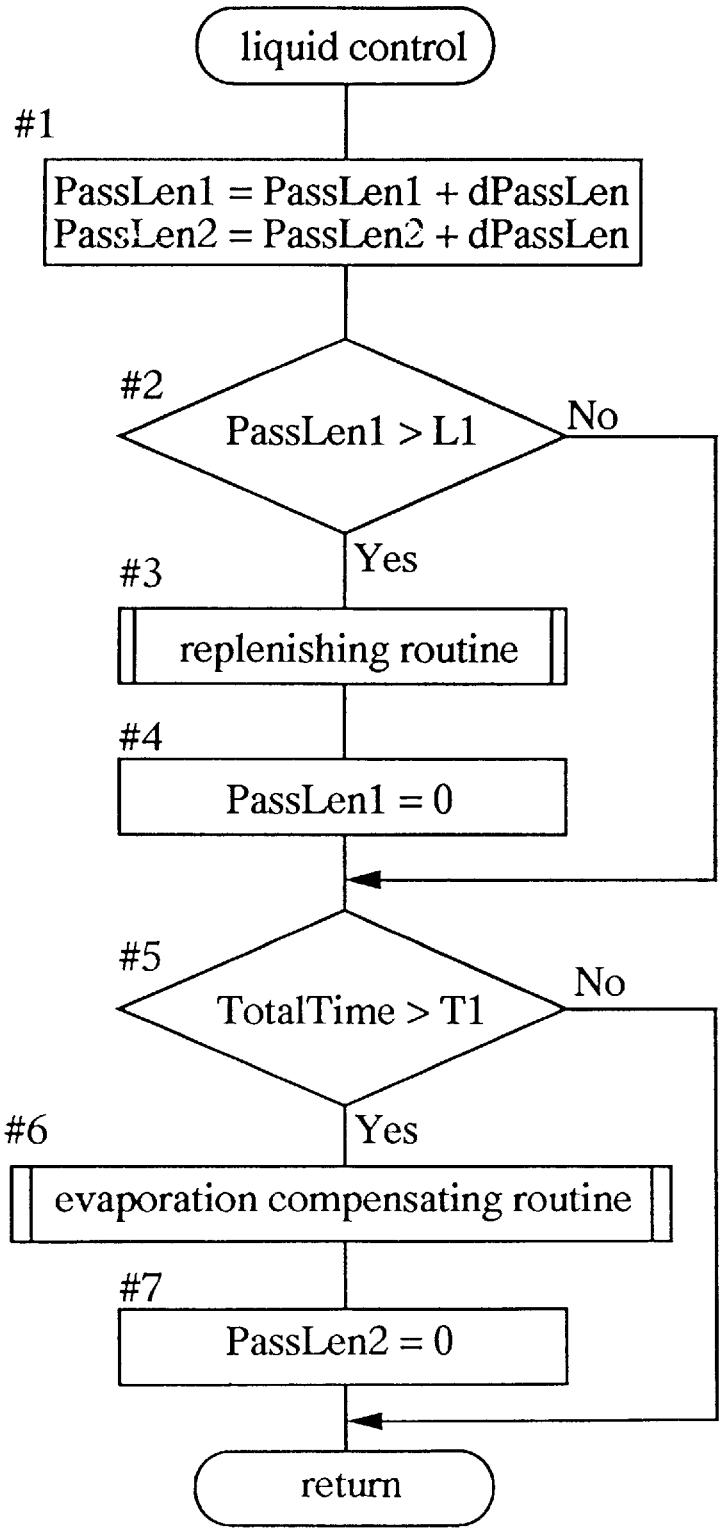
FIG. 4 is a flow chart illustrating a liquid control routine.

Upon start-up of a liquid control program of FIG. 4 as an interrupt routine periodically executed by predetermined intervals, the length of the film passing the film developing section 3 is obtained as a processing amount of the processing tanks (#1). A mark: PasssLen 1 denotes the film passage length which is to be utilized for liquid replenishment, representing the length of the film 1 passed within the period between the previous interrupt and the current interrupt. Unless the obtained processing amount: PassLen 1 exceeds a preset reference value: L1 (#2), the process does not enter the liquid replenishing routine and jumps to step #5. Whereas, if the processing amount: PassLen 1 has exceeded the preset reference value: L1 (#2), the process enters the replenishing routine, of which details will be given later, for effecting replenishing and draining of the processing liquid (#3). Upon return from the liquid replenishing routine, the processing amount is initialized (#4) to be ready for a next replenishing cycle.

In this particular embodiment, the water evaporation compensation is effected by predetermined interval. Therefore, the process checks whether a predetermined period: T1 from the previous compensation operation has lapsed or not (#5). If not, the process bypasses the evaporation compensation routine and terminates this interrupt process. On the other hand, if the predetermined time period: T1 has lapsed, the process enters the evaporation compensating routine, of which details will be given later, for supplying additional water to compensate for water content lost through evaporation (#6). Upon returning from the evaporation compensating routine, the film processing amount is initialized (#7) to be ready for a next evaporation compensating operation.

Figure 5:
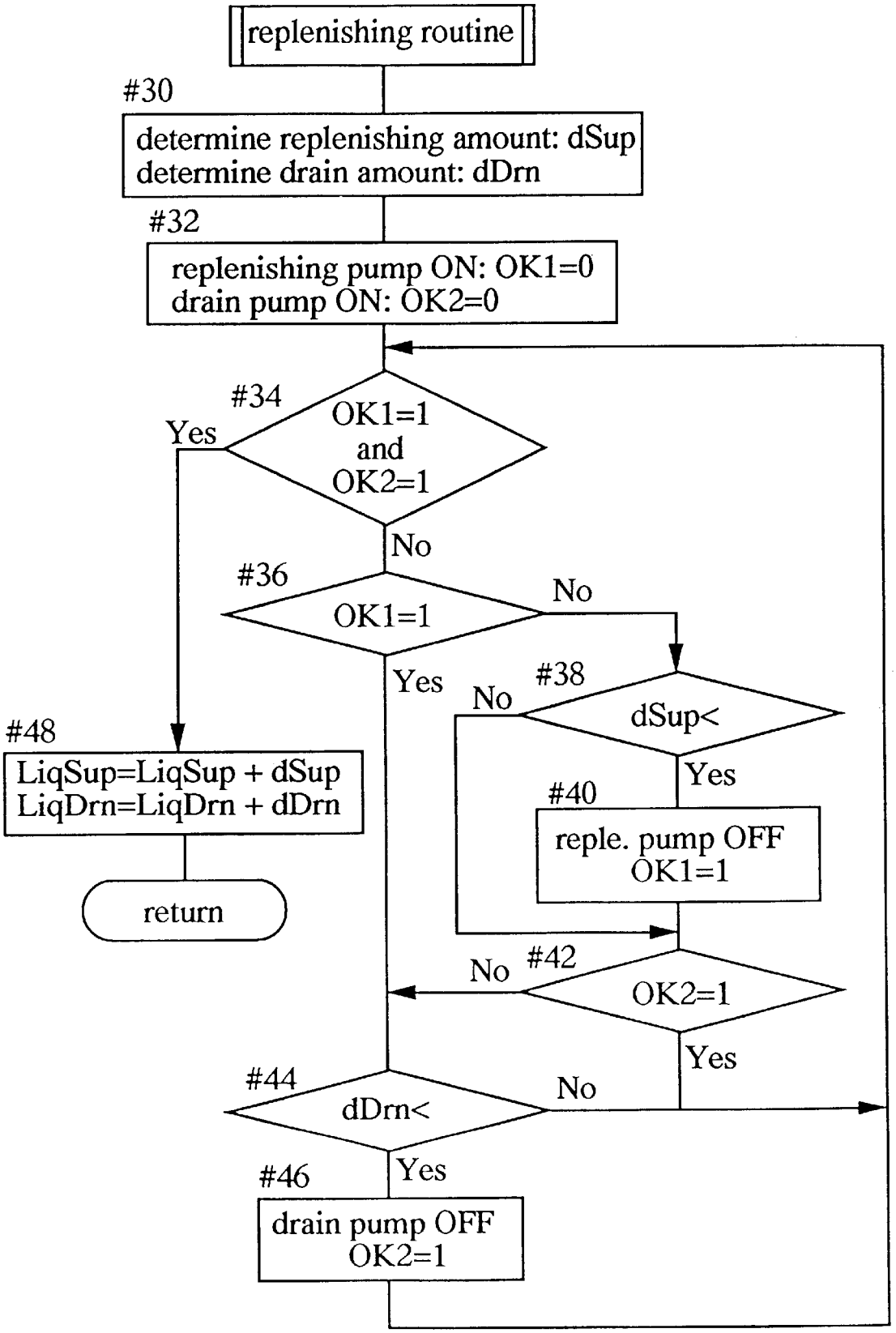
FIG. 5 is a flow chart illustrating a liquid replenishing routine.

The liquid replenishing routine is illustrated in the flow chart of FIG. 5. In this routine, first, with reference to the look-up table prepared in advance in the manner described hereinbefore, the process determines a current replenishing amount: dSup and drain amount: dDrn (#30). Next, the replenishing pump and the draining pump are activated and also a flag: OK1 indicating stop of operation of the replenishing pump and a flag: OK2 indicating stop of operation of the draining pump are set to '0', respectively (#32). At step #34, these flags: OK1, OK2 are checked. Then, unless both of the replenishing pump and draining pump are out of operation, i.e. unless both of the liquid replenishing operation and draining operation are completed, the process further checks whether the replenishing operation has been completed or not (#38). If the operation completed, the replenishing pump is stopped and also the flag: OK1 is set to '1' (#40), then, the process goes to step #42. Conversely, if the operation not yet completed, the process jumps to step #42. At this step #42, the process checks whether the draining operation has been completed or not. If the draining operation is still going on, the process checks whether the current draining amount: dDrn has been achieved or not (#46). If the amount has been achieved, the draining pump is stopped and also the flag: Ok2 is set to '1' (#46) and then the process returns to step #34. If the amount has not yet been achieved, the process directly returns to step #34. In summary, unless both the replenishing operation and the draining operation have been completed, the process continues to monitor the ongoing operation(s). Then, when both the operations have been completed (#34), the current replenishing amount: dSup is added to the previous replenishing amount: LiqSup, i.e. the amount of replenishment which has taken place since the previous evaporation compensation operation, and also the current draining amount: dDrn is added to the previous draining amount: LiqDrn, i.e. the amount of draining which has taken place since the previous evaporation compensation operation (#48). With this, this replenishing routine is completed.

Figure 6:
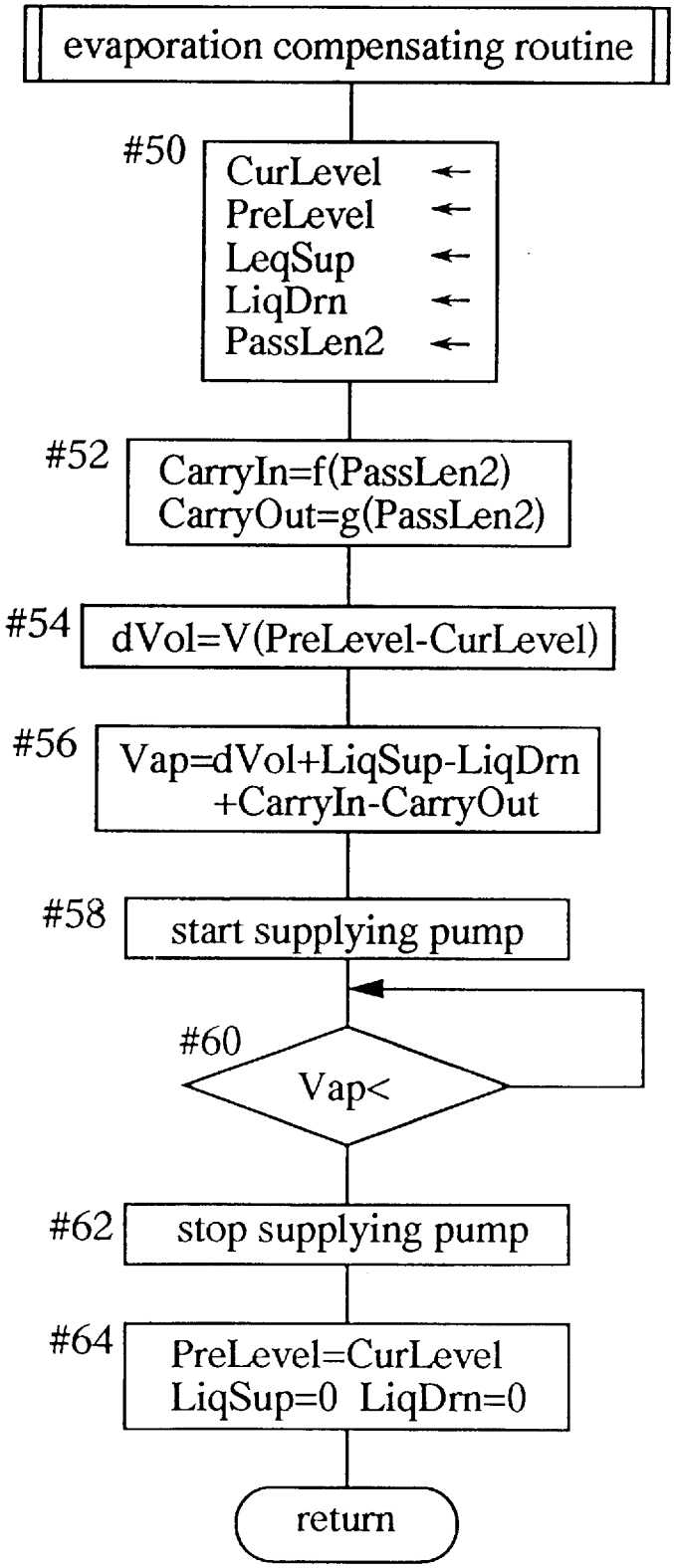
FIG. 6 is a flow chart illustrating a water evaporation compensating routine.

The evaporation compensation routine is illustrated in FIG. 6. In this routine, the process first enters a current liquid level: CurLevel of the processing tank subjected to the evaporation compensation. Then, the process prepares a previous liquid level: PreLevel of the processing tank at the time of the previous evaporation compensation, the replenishing amount: LiqSup and draining amount: LiqDrn which represent the amounts of replenishment and draining which have taken place since the previous evaporation compensation and the passage length: PassLens 2 which represents the film processing amount obtained in the liquid control routine described hereinbefore (step #50). Subsequently, the process determines the carry-in amount: CarryIn and the carry-out amount: CarryOut of the processing liquid by the film 1, with using the film processing amount, i.e. the length of the film passed, as a parameter (step #52). These functions: f, g are obtained experimentally. Incidentally, in the case of the developing liquid processing tank 31, since this tank is disposed on the most upstream side in the transporting direction of the film 1, the carry-in amount of the processing liquid may be set to '0'. Further, a change amount: dVol is obtained from the current liquid level: CurLevel and the previous liquid level: PreLevel (step #54).

Then, the evaporation amount can be obtained generally from the following expression:

$$\text{Vap}=F(d\text{Vol}, \text{liqSup}, \text{LiqDrn}, \text{CarryIn}, \text{CarryOut})$$

That is to say, the evaporation amount can be expressed as a function of all of the liquid input and output amounts to and from the processing tank. This is because, if all of the input and output amounts of liquid to and from the processing tank within a predetermined period are controlled with accuracy, the resultant shortage of the liquid may be considered as the amount of water content evaporation that has taken place within the period. This embodiment employs the following simplest calculation to obtain the evaporation amount: Vap. Namely;

$$\text{Vap}=d\text{Vol}+\text{LiqSup}-\text{LiqDrn}+\text{CarryIn}-\text{CarryOut}$$

The process determines the evaporation amount by the above expression (step #56) and then activates the water supplying pump to supply an amount of water corresponding to this determined evaporation amount (step #58). The process continues to drive the water supplying pump until the above water supply amount is achieved (step #60). When the amount has been achieved, the water supplying pump is stopped (#62). Lastly, in preparation for the next evaporation compensation operation, the process enters the current liquid level: CurLevel to the previous liquid level: PreLevel and resets the liquid replenishing amount: LiqSup and the liquid draining amount: LiqDrn to '0' respectively (step #64), thereby to complete this evaporation compensation routine.

In the foregoing embodiment, the control scheme relating to the liquid amount control in consideration of the liquid replenishment and water evaporation is applied only to the developing liquid processing tank 31 and the bleaching liquid processing tank 32. Needless to say, however, the control scheme may be applied also to the other processing tanks. Such application too is encompassed within the scope of the present invention.

Further, in the foregoing embodiment, the liquid draining operation and the liquid replenishing operation are effected simultaneously. Instead, these operations may be effected with a delay one relative to the other. Also, instead of disposing the liquid-amount sensors in the respective pipes, it is also possible to dispose them in the tanks for checking the liquid amounts, on which the drives of the respective pumps may be controlled. As an alternative example of the liquid amount detecting means, it is also conceivable to determine the amount of liquid present in the tank by detecting change in the weight of the tank. As described hereinbefore, the essential feature of the present invention lies in that the calculation of the water evaporation amount and the water supplying operation based thereon are effected through accurate management of the input and output liquid amounts to and from the processing tank, rather than by indirect determination of the evaporation amount from experimentally measured values of various ambience conditions such as temperature and humidity.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description and all changes which come within the meaning and range of equivalency of the claims are therefore intended to be embraced therein.

What is claimed is:

1. A photographic processing apparatus comprising:

means for supplying processing liquid to a processing tank;

means for forcibly draining processing liquid from the tank;

means for measuring an amount of processing liquid in the tank;

means for determining an amount of water evaporated from the liquid in the tank based on amounts of liquid coming in and out of the tank; and means for supplying an amount of additional water to the tank based on the amount of water evaporation determined by the evaporation amount determining means.

2. A photographic developing apparatus as claimed in claim 1, further comprising means for determining an amount of material to pass the tank to be developed therethrough;

wherein the evaporation amount determining means includes a carry-in amount determining unit for determining an amount of the liquid carried with the material into the tank based on the amount of the passed material determined by the passage amount determining means and a carry-out amount determining unit for determining an amount of liquid carried with the material out of the tank based on the amount of the passed material determined by the passage amount determining means.

3. A photographic developing apparatus as claimed in claim 2, wherein the evaporation amount determining means calculates the evaporation amount from parameters including a change amount, replenishing amount, draining amount, carry-in amount and carry-out amount, which are measured for a predetermined period of the liquid stored in the processing tank.

4. A photographic developing apparatus as claimed in claim 3, wherein the evaporation amount determining means calculates the evaporation amount by subtracting the draining amount and the carry-out amount from the sum of the change change amount, the replenishing amounts and the carry-in amount measured for the predetermined period.

5. A photographic developing apparatus as claimed in claim 2, wherein the liquid supplying means and the liquid draining means are driven, based on the amount of the material passed which amount is determined by the passage amount determining means, so as to replace a portion of the processing liquid for the purpose of preventing quality deterioration thereof.

6. A photographic developing apparatus as claimed in claim 5, wherein the liquid supplying means and the liquid draining means are driven in such a manner that the amount of processing liquid present in the processing tank is constantly maintained within a predetermined range.

7. A photographic developing apparatus as claimed in claim 1, wherein the liquid supplying means includes a supplying tank and a supplying pump, the liquid draining means includes a draining tank and a draining pump, and the respective tanks and pipes communicated therewith include a liquid amount detecting means or a flow-amount sensor.

8. A method of supplying water to a photographic processing apparatus which includes means for supplying processing liquid to a processing tank, means for forcibly draining processing liquid from the tank, means for measuring an amount of processing liquid in the tank, and means for supplying an amount of additional water to the tank, which method comprising the steps of:

determining an amount of water evaporated from the liquid in the tank based on amounts of liquid coming in and out of the tank; and supplying an amount of additional water to the tank based on the determined amount of water evaporation.

9. A method as claimed in claim 8, wherein the step of determining the evaporation amount includes a step of determining a carry-in amount of the liquid carried with the material into the tank and a step of determining a carry-out amount of the liquid carried with the material out of the tank are determined, based on an amount of material to pass the processing tank to be developed therethrough.

10. A method as claimed in claim 9, wherein in the step of determining the evaporation amount, the evaporation amount is calculated from parameters including a change amount, replenishing amount, draining amount, carry-in amount and carry-out amount, which are measured for a predetermined period of the liquid stored in the processing tank.

* * * * *